United States Patent [19]

Hayashi et al.

[11] Patent Number: 4,590,023

[45] Date of Patent: May 20, 1986

[54] METHOD FOR MANUFACTURING AN INJECTION-MOLDED FOAM CORE SKI PLATE

[75] Inventors: Keijiro Hayashi, Takatsuki; Toshimi Awano, Ohgaki; Shigeru Asai, Gifu, all of Japan

[73] Assignee: Mizuno Corporation, Osaka, Japan

[21] Appl. No.: 609,670

[22] Filed: May 14, 1984

[30] Foreign Application Priority Data

Jul. 19, 1983 [JP] Japan ..... 58-132228

[51] Int. Cl.[4] ..... B29C 67/22; B29C 45/14

[52] U.S. Cl. ..... 264/46.5; 264/261; 264/328.6; 264/DIG. 83; 425/543; 425/817 R

[58] Field of Search ..... 264/46.5, 46.6, DIG. 83, 264/261, 328.6; 249/91; 425/817 R, 543

[56] References Cited

U.S. PATENT DOCUMENTS

| | | | |
|---|---|---|---|
| 2,976,577 | 3/1961 | Gould | 264/46.5 X |
| 3,733,380 | 5/1973 | Ishida | 264/46.6 X |
| 3,816,573 | 6/1974 | Hashimoto et al. | 264/46.5 |
| 3,958,810 | 5/1976 | Böhm | 249/91 X |
| 4,259,274 | 3/1981 | Tiitola | 264/46.5 |
| 4,386,982 | 6/1983 | Weinhaus | 264/46.5 X |

FOREIGN PATENT DOCUMENTS

| | | |
|---|---|---|
| 26-11558 | 10/1951 | Japan . |
| 33-7126 | 8/1958 | Japan . |
| 39-37625 | 12/1964 | Japan . |
| 40-6855 | 3/1965 | Japan . |

*Primary Examiner*—Philip Anderson

*Attorney, Agent, or Firm*—Fleit, Jacobson, Cohn & Price

[57] ABSTRACT

Method of manufacturing an injection-molded ski plate comprising steps of disposing a lower side member in a lower mold, disposing an upper side member in the lower mold, disposing an upper mold formed with a concaved portion corresponding to a roof-like shape with the widthwise central part of the ski plate and injecting a foaming synthetic resin into a hollow space between the lower and upper members and harding after foaming, whereby the upper member is molded following the roof-like concaved portion so that a convexed roof-like portion is formed on the upper member.

3 Claims, 14 Drawing Figures

FIG. 1
(PRIOR ART)
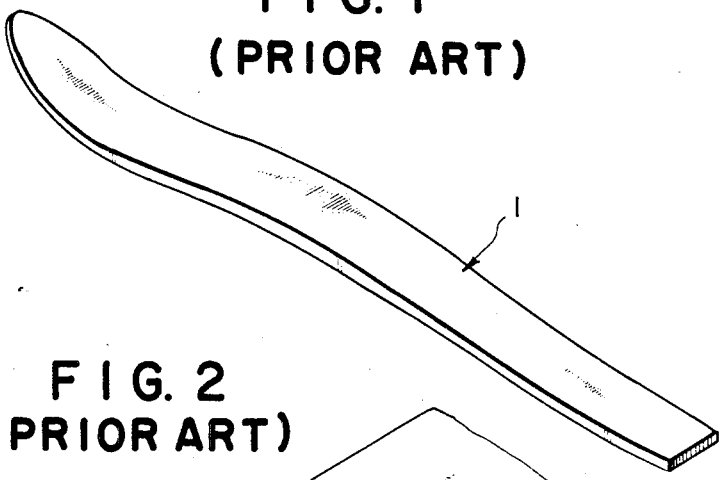
FIG. 2
(PRIOR ART)
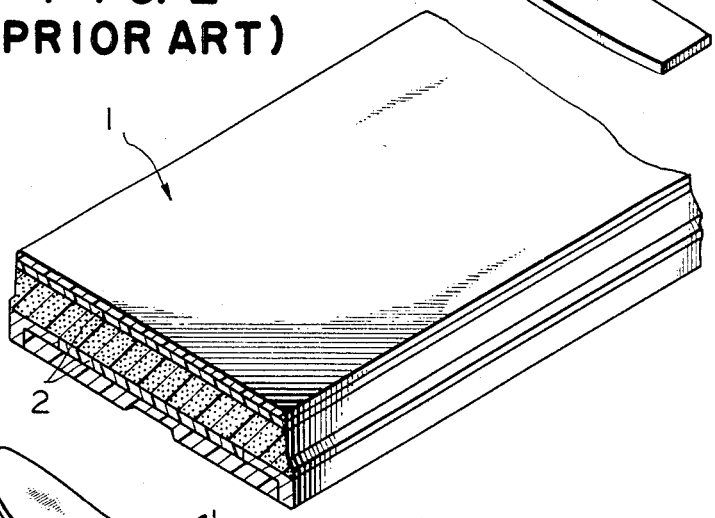
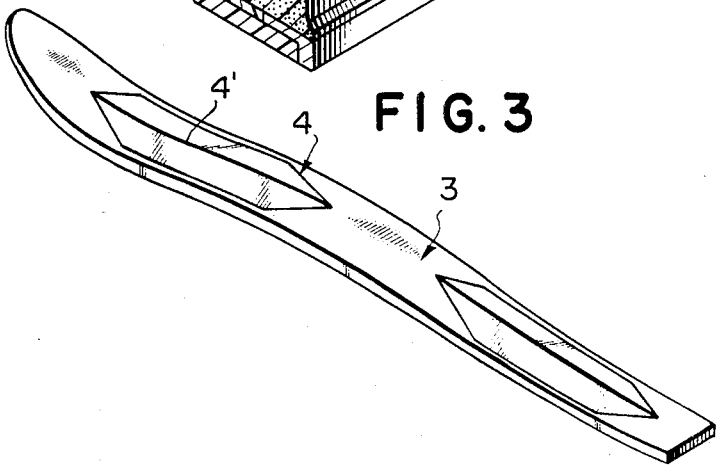
FIG. 3

METHOD FOR MANUFACTURING AN INJECTION-MOLDED FOAM CORE SKI PLATE

This invention relates to a method of manufacturing an injection-molded ski plate in which the widthwise central part of an upper side constituting member is shaped into the high chevron-like form or ridged form.

Heretofore, there are known various ski plates made of woods, FRP, metal glass, etc.

In the former years, to maintain the strength, wooden ski plates were oftenly used which have the upper surface ridged into the keel-like form. Such keel-like wooden ski plates, however, have a heavy weight, are poor in maneuverability and lack the flexural rigidity, so they have been more flattened with the change of the times. Then, wood-made ski plates have been replaced by those which are made of FRP or metals and have better performance. At present, there is popularized such a ski plate 1 as shown in FIG. 1 which has the tapered form on both front and rear sides such that the thickness of the ski plate is gradually increased from the front end to the central part thereof and gradually decreased from the central part to the rear end thereof, and which has the flat upper surface. As to the internal structure, there are known a sandwiched construction that reinforcement member 2 such as FRP plates are disposed on both upper and lower sides of a core material, as illustrated in FIG. 2, and a box-like construction that a reinforcement member is disposed all over the periphery of a core material.

These constructions are generally adopted by many ski plate makers because of the simplified process for manufacturing ski plates having such constructions.

On the other hand, from the viewpoint of physical properties of ski plates, it has been always very difficult problem how to design the ski plates with a view of making good balance of various parameters meters such as torsion strength, bending strength, vibration damping property, air resistance, etc. which influence to one another.

For example, improvement in the torsion strength of a ski plate necessarily increases the bending strength, thereby resulting in such defects that the ski plate becomes unvivid to act, the vibration damping property is lowered, and hence the sliding performance is adversely influenced.

Moreover, for the purpose of reducing air resistance of a ski plate during sliding, it has been also devised to bore one or more holes with the appropriate forms in a shovel portion of the front end of the ski plate, or to lower the level of the raised shovel portion, thereby to restrain the air resistance as much as possible and increase the speed during sliding. But, these methods are disadvantageous in that the manufacturing process is time-consuming and the manufacturing cost becomes expensive.

The other objects and advantages of the invention will be more apparent from the following explanation relating to the attached drawings.

FIG. 1 is a perspective view showing a ski plate in the prior art.

FIG. 2 is a perspective sectional view showing an essential part of the ski plate in FIG. 1.

FIG. 3 is a perspective view showing a ski plate having the chevron like roof portion.

Figure 4:
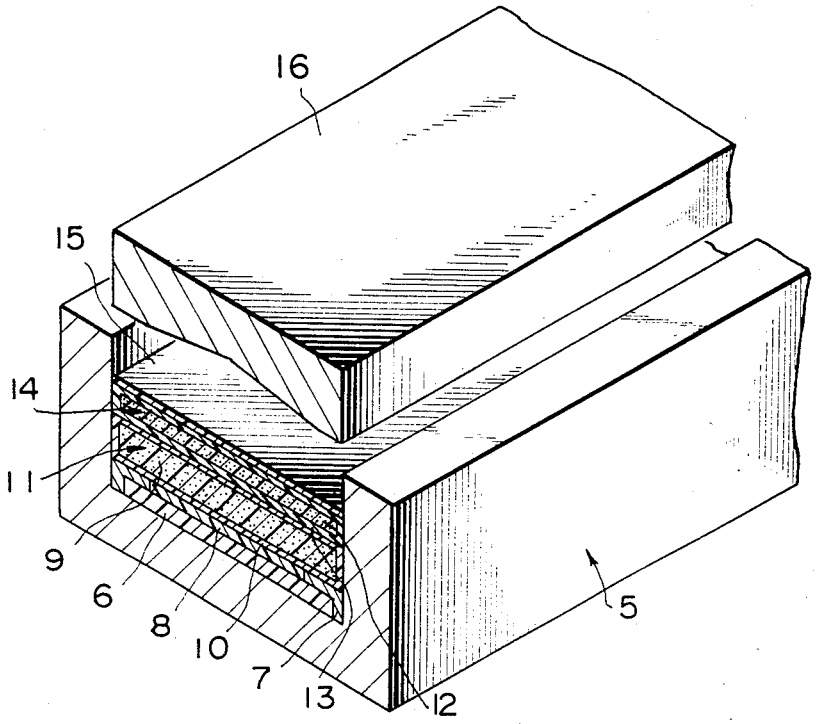
FIGS. 4 through 7 are perspective sectional views showing the ski plate in FIG. 3 and the method of manufacturing the same.
Figure 5:
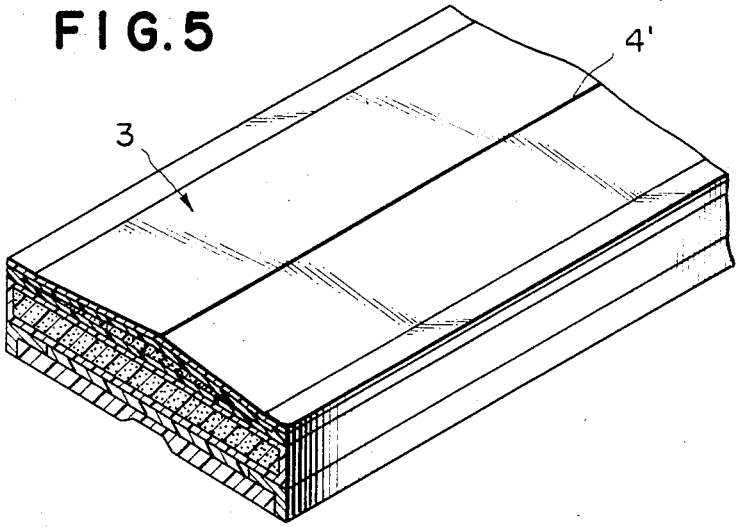
Figure 6:
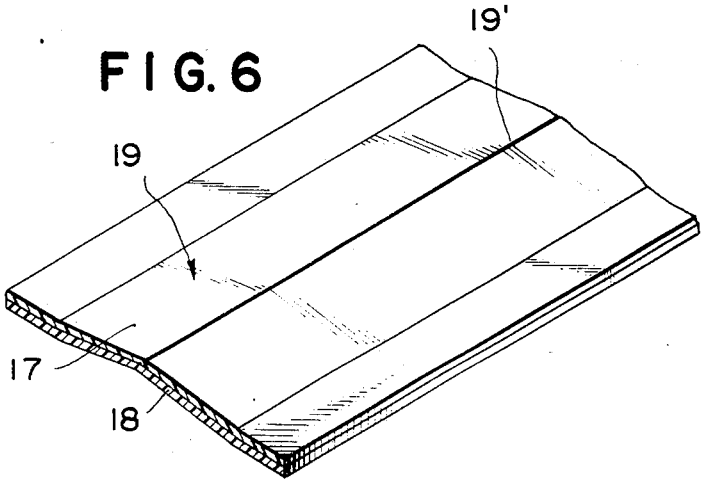
Figure 7:
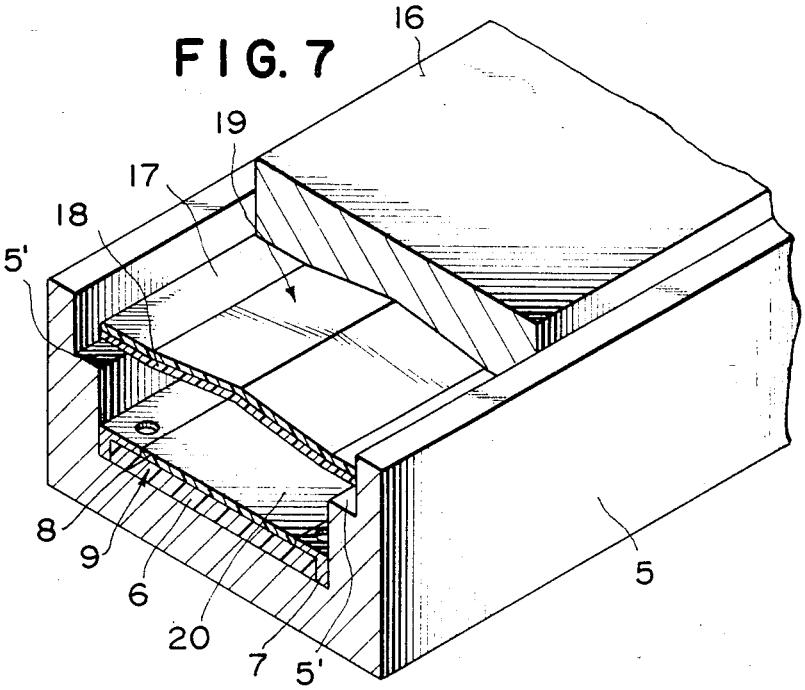

With a view of solving the above-mentioned defects in the prior art ski plates, the inventors have previously invented a ski plate 3 as shown in FIG. 3, which has an upper side constituting member 4 including a chevron-like roof portion 4'' with the widthwise central part of the ski plate locating at the top. Also, the inventors have proposed a method of manufacturing such a ski plate formed at its upper side with the ridged chevron-like roof portion wherein, as illustrated in FIGS. 4 and 5, a sliding surface material 6, a steel edge 7, a reinforce-member 8, etc. are assembled into a lower metallic mold 5 for molding ski plates, then a central core member 11 formed of a hard core material coated with a fiber reinforcement member 10 is arranged, then an auxiliary member 14 adapted to form the chevron-like roof portion and consisted of a soft core material 2 coated with a fiber reinforcement member 13 is disposed on the central core member 11, then an upper surface member 15 is disposed thereon, then an upper metallic mold 16 having the chevron-like indented surface to form the chevron-like roof portion is placed on the upper surface member 15 except for the front end part, the binding mounting part and the rear end part of the ski plate, and finally the respective components are heated and hardened under high pressure. In addition, the inventors have further invented a method of manufacturing an injection-molded ski plate wherein, as illustrated in FIGS. 6 and 7, a lower side constituting member 9 comprising a sliding surface material 6, a steel edge 7, a reinforcement member 8, etc. is disposed in a lower metallic mold 5 for molding ski plates, then an upper side constituting member 19 comprising an upper surface material 17, a reinforcement member 18, etc. having the pre-formed chevron-like roof portion with the widthwise central part therof locating at the top is disposed on an inner stepped portion 5' of the lower metallic mold, then an upper metallic mold 16 shaped to coincide with the roof-like form of the upper side constituting member 19 is arranged, and finally a foamable thermosetting synthetic resin is injected into a hollow space 20 defined between the lower and upper side constituting members 9, 19 and then hardened after foaming, thereby to integrally mold the ski plate. The ski plates manufactured by the above manufacturing methods have various good characteristics which could not been obtained in the conventional ski plates. However, the former manufacturing method requires the large number of assembled members and the resultant ski plates tend to have characteristics fit for medium or high class skiers. So there had been demanded a manufacturing method able to supply also ski plates for beginners. The latter manufacturing method was devised for this purpose, but it has accompanied with such problems as follows. It is required that the upper side constituting member 19 is pre-molded in advance using another metallic mold to form the chevron-like roof portion, and hence the cost becomes relatively high. Further, the process of placing the upper metallic mold to coincide with the chevron-like roof portion 19' of the upper side constituting member disposed in the lower metallic mold is troublesome and time-consuming, so that it can not supply but ski plates for medium class skiers practically in the point of cost.

The present invention has been accomplished with an object to solve the foregoing problems in the prior art and to supply an injection-molded ski plate which has the reduced manufacturing cost, characteristics optimum for all skiers ranging from the beginning class to the higher class from the viewpoint of performance, as well as high durability.

Figure 8:
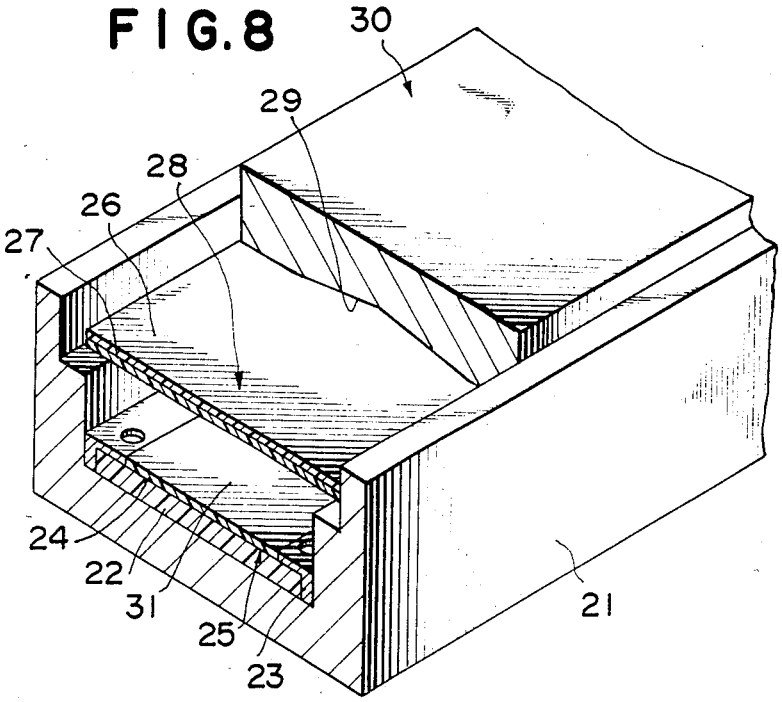
FIG. 8 is a perspective sectional view of an essential part of an injection-molded ski plate in accordance with the present invention, for showing a part of the manufacturing process thereof.
Figure 9:
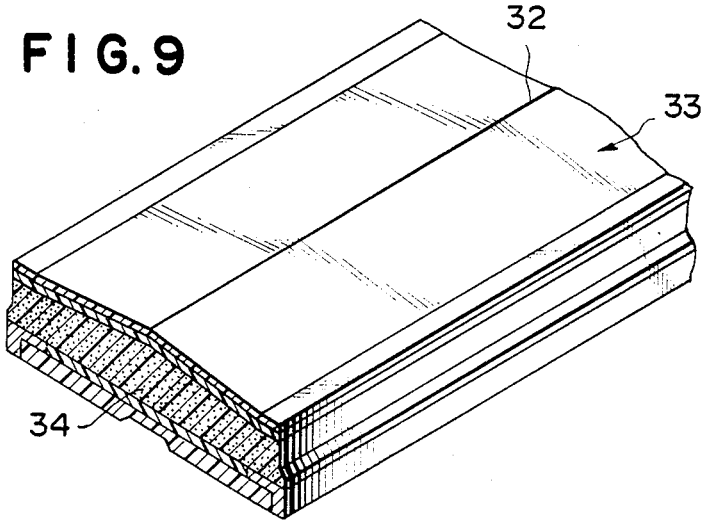
FIGS. 9, 12, 13 and 14 are perspective sectional views of essential parts showing several embodiments of the injection-molded ski plate.
Figure 10:
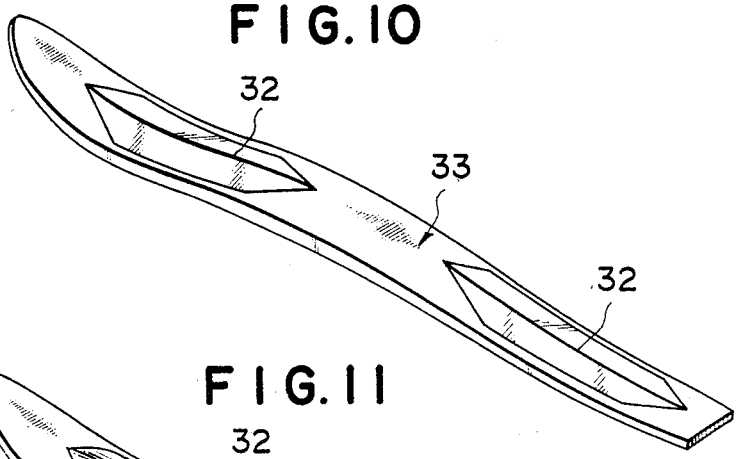
FIG. 10 is a perspective view of the injection-molded ski plate having the chevron-like roof portions.
Figure 11:
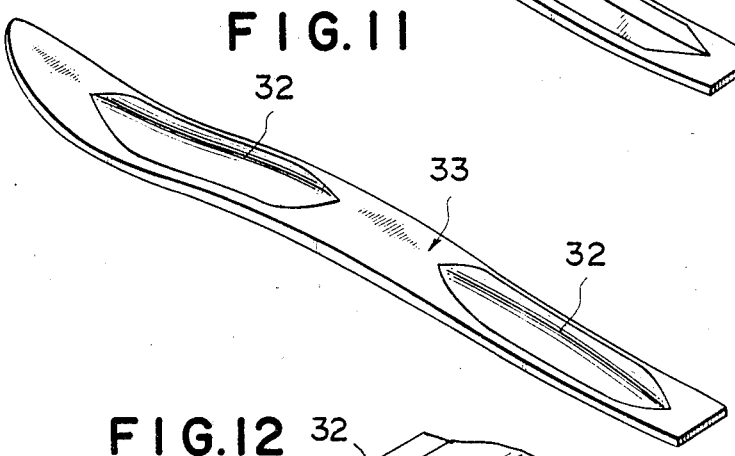
FIG. 11 is a perspective view of the injection-molded ski plate having the arch-like roof portion.

Hereinafter, the present invention will be described with reference to the drawings. According to the invention, the method of manufacturing an injection-molded ski plate is featured as follows. As shown in FIGS. 8 and 9, a lower side constituting member 25 comprising a sliding surface material 22, a steel edge 23, a reinforcement member 24, etc. is first disposed in a lower metallic mold 21 for molding ski plates, and an upper side constituting member 28 comprising an upper surface thermoplastic resin material 26, a reinforcement member 27, etc. is disposed in the lower metallic mold above the lower side constituting member 25. Subsequently, an upper metallic mold 30 formed with a chevron-like indented portion 29 for providing the chevron-like roof portion with the widthwise central part of the ski plate locating at the top is disposed thereon, and a foamable thermosetting synthetic resin is injected through inlet means (not shown) located at the end of the lower mold 21 into a hollow space 31 defined between the lower and upper side constituting members 25, 28 and then hardened after foaming. Due to the expansion and reaction heat of the foamable resin, the upper side constituting member 28 is deformed upwardly following the chevron-like indented portion 29 of the upper metallic mold 30, thereby to simultaneously integrally mold a chevron-like roof portion 32 on the upper side constituting member 28.

The injection-molded ski plate thus manufactured in accordance with the present invention, unlike that manufactured by the conventional method, does not require to pre-mold the upper side constituting member to form the chevron-like roof portion in advance, so that the process of pre-molding can be eliminated and another metallic mold for pre-molding can be also dispensed with. This results in the reduced manufacturing cost. Further, it is possible to optionally determine the position of the chevron-like roof portion, and the form of the roof portion can be optionally selected to, for example, the arch or trapezoid form by shaping the indented portion of the upper metallic mold into different forms. In other words, the form of the roof portion can be easily varied by preparing several kinds of upper metallic molds without the need of changing the lower metallic mold, so it becomes possible to manufacture various ski plates.

It is to be noted that, in the present invention, an ABS resin plate, a phenol plate, or other plates may be used as the upper surface material, and a reinforced plastic plate formed of glass fibers, carbon fibers, or other appropriate reinforcing fibers may be used as the reinforcement member. However, the upper surface material and the reinforcement member may be commonly formed of a single fiber-reinforced plastic plate such as a carbon fiber-reinforced plastic plate or other fiber-rinforced plastic plates using silicon carbide fibers, alumina fibers, glass fibers, etc.

In the present invention, since the roof portion in the chevron-like or other appropriate shape is formed on the upper side constituting member utilizing a foaming pressure of the foamable thermosetting synthetic resin and the reaction heat produced at the time of foaming, it is required to select the thickness of the upper surface material or reinforcement member, but the selecting condition is not so severe. More specifically, in case of using a foaming polyurethane synthetic resin, the reinforcement with a thickness of about 0.8 mm to 1.0 mm can be molded sufficiently. In case of combinedly using foaming gas such as FREON (trademark) gas (fluorohydrocarbon), the thickness of the upper surface material or reinforcement member can be selected optionally. Further, since the kind, manner of weaving and other properties of fibers used in the reinforcement member can be also selected optionally, it becomes possible to desirously design the ski plates with various characteristics fit for skiers ranging from the beginning class to the higher class. This remarkably improves the freedom of design. It is also to be understood that the reinforcement member employed in the present invention may be constituted by a material in the form of the foregoing fiber-reinforced plastic plate or in other forms such as prepreg and wet lay-up as desired.

As fully described hereinabove, the injection-molded ski plate according to the present invention has the increased freedom of design and, therefore, the manufactured ski plate is formed with the roof portion 32 having the chevron-like or other desirous forms, so that torsion rigidity is increased and bending rigidity is decreased. Thus, it is possible to supply the ski plates having good maneuverability fit even for beginners. Proper selection of materials for the reinforcement naturally permits to supply the ski plates fit for higher class skiers. There can be also attained such effects that vibration damping property is greatly improved during sliding due to the presence of the roof portion 32, and hence maneuverability is improved.

Figure 12:
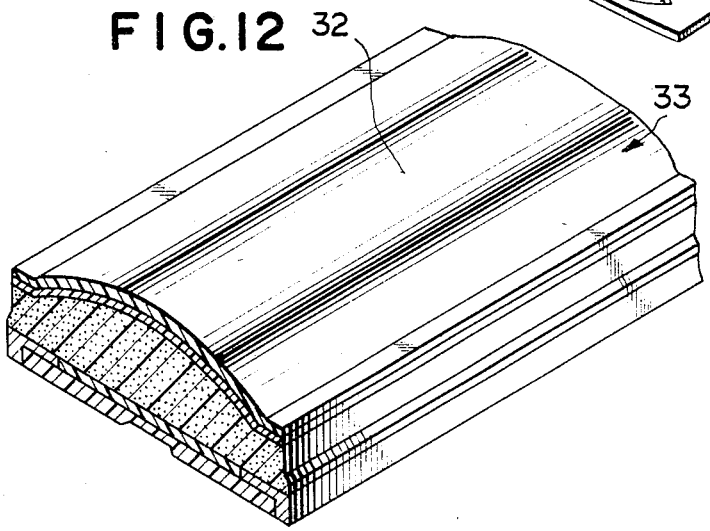
Figure 13:
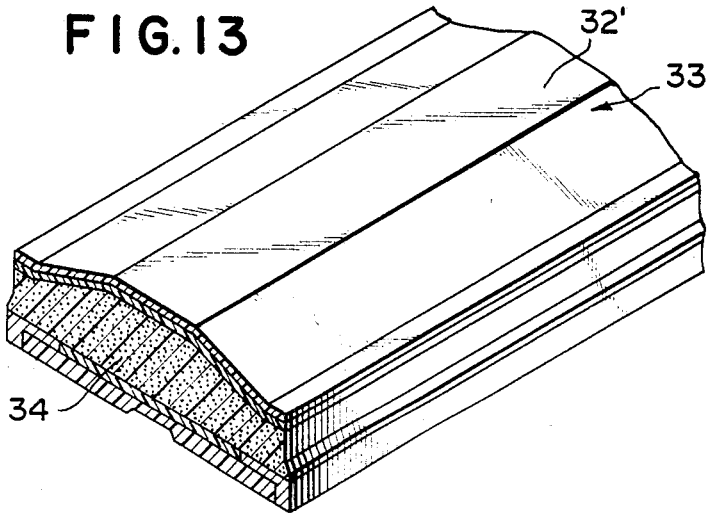
Figure 14:
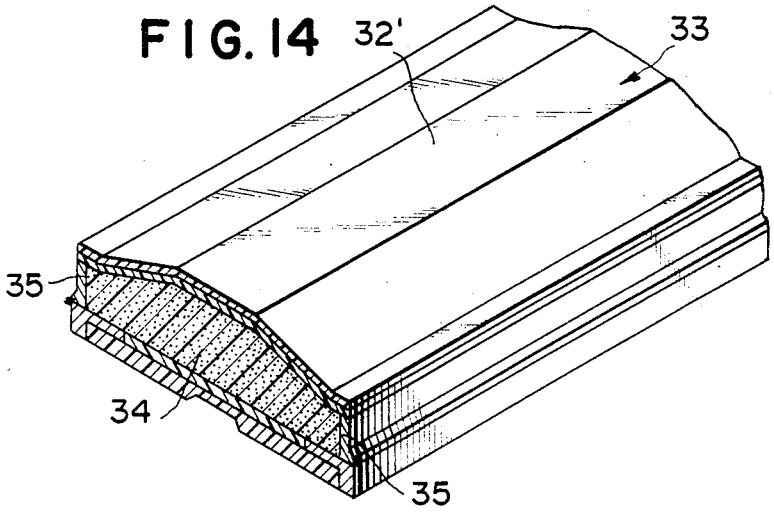

As an alternative embodiment, side members may be mounted as illustrated in FIG. 14. When the roof portion 32 is shaped into the arch-like form as shown in FIG. 12, air resistance is reduced to increase the sliding efficiency and an amount of deposited snow becomes small. On the other hand, when the roof portion is shaped into the trapezoid form 32' as illustrated in FIGS. 13 and 14, torsion rigidity is improved and hence it becomes possible to supply ski plates strong against twisting.

Moreover, by extending or shortening the length of the roof portion 32 toward the front or rear end of the ski plate, bending rigidity and torsion rigidity of the ski plate can be changed variously. This results in a valuable feature the ski plate can be designed to have a hard or soft condition and flexibility as required. In FIGS. 9 to 14, the ski plate is shown by a reference number 33, the core member is shown by a number 34, and side members are shown by numbers 35 and 35.

As will be apparent from the above description, according to the present invention there is simply provided an injection-molded ski plate fit for all skiers ranging from the beginning class to the medium or higher class, because both yield and productivity are improved and the freedom of design is enlarged.

We claim:

1. A method of manufacturing an injection-molded ski plate, said method comprising:

positioning a lower side constituting member and an upper side constituting thermoplastic resin member in a lower mold in a spaced apart relationship to define a hollow space between said lower side constituting member and said upper side constituting member;

disposing on the upper side constituting member an upper mold formed with a concaved portion having a desired roof-like shape; and injecting a foamable thermosetting synthetic resin into said hollow space, the expansion and reaction heat of said resin resulting in deformation of said upper side constituting member to follow said concaved portion of said upper mold so that a convex roof-like portion is integrally formed on said upper side constituting member with the expansion of said resin.

2. A method of manufacturing an injection-molded ski plate as in claim 1, wherein said upper mold forms said concaved portion in a widthwise central part of the upper side constituting member.

3. A method of manufacturing an injection-molded ski plate as in claim 2, wherein said lower side constituting member includes a sliding surface material, steel edges and a reinforcement member and said upper side constituting member includes an upper surface thermoplastic resin material and a reinforcement member.

* * * * *